United States Patent [19]

Lueth

[11] 4,431,605

[45] Feb. 14, 1984

[54] METALLURGICAL PROCESS

[75] Inventor: Roy C. Lueth, 6748 Rattle Run Rd., St. Clair, Mich. 48079

[73] Assignee: Roy C. Lueth, St. Clair, Mich.

[21] Appl. No.: 375,681

[22] Filed: May 6, 1982

[51] Int. Cl.[3] ..... B22F 3/00; B22F 3/24

[52] U.S. Cl. ..... 419/26; 419/28; 419/47; 419/48; 419/49

[58] Field of Search ..... 419/47, 48, 49, 26, 419/28

[56] References Cited

U.S. PATENT DOCUMENTS

| | | | |
|---|---|---|---|
| 3,320,056 | 5/1967 | Stoops | 419/48 |
| 3,441,392 | 4/1969 | Divecha et al. | 419/47 |
| 3,765,958 | 10/1973 | Freche et al. | 419/47 |
| 4,244,738 | 1/1981 | Storchheim | 419/48 |

OTHER PUBLICATIONS

Pp. 6 and 64 of Sam Sonov G. V. Hot Pressing Technology in the Soviet Machine Bldg. and Metallurgical Industries.

Goetzel Treatise on Powder Metallurgy, vol., 1949 (pp. 424–425).

*Primary Examiner*—Brooks H. Hunt

*Attorney, Agent, or Firm*—Gifford, VanOphem, Sheridan, Sprinkle & Nabozny

[57] ABSTRACT

The present invention discloses a method for densifying previously sintered parts constructed of powdered metals, ceramics or the like to nearly 100% theoretical density. The method of the present invention comprises heating the parts above their liquid phase temperature and then applying a pressure in the range of 50–2,000 psi to the parts for a predetermined period of time and simultaneously maintaining the parts at or above their liquid phase temperature. The method of the present invention achieves complete closure of even large voids and the elimination of substantially all porosity within the part.

6 Claims, 14 Drawing Figures

METALLURGICAL PROCESS

BACKGROUND OF THE INVENTION

I. Field of the Invention

The present invention relates to a method for densifying previously sintered parts of powdered metals, ceramics and the like.

II. Description of the Prior Art

In the liquid phase sintering of powdered metals, ceramics, and the like, the powdered material is first intermixed with a fugitive binder which holds the part in the desired shape after cold pressing. Usually this fugitive bonder or "wax" consists of a paraffin, polyetheleneglycol or a metal containing a hydrocarbon. The cold pressed part is conventionally known as a preform.

The preforms are then subjected to a presintering step in which the preforms are slowly heated thus vaporizing the fugitive binder and the vaporized binder is removed from the part by a wash gas, vacuum pumping or other means. Following the presintering step, the parts retain their shape despite the absence of the fugitive binder.

The parts are then subjected to a sintering operation in which the parts are raised to their liquid phase temperature which not only densifies the parts but also further releases any residual contaminants contained within the parts. These contaminants are removed from the part during the sintering operation by vacuum pumping or by flowing a wash gas, such as hydrogen, across the parts. Following the sintering of the parts, the parts are sufficiently dense and hard for many applications.

For applications requiring still further densification, greater strength of the sintered part or better internal integrity, these properties of the part can be improved by subjecting the part to hot isostatic pressing or "HIP" processing. During HIP processing, the parts are elevated to their liquid phase temperature and subjected to pressures in excess of 5,000 psi and typically in excess of 10,000 psi, for a period of 60 to 90 minutes. The primary advantage of HIP processing is to eliminate virtually all porosity within the part as well as greatly minimizing larger randomly spaced holes, slits or fractures which may be present in the part provided such holes, slits or fractures are not open to the surface.

A primary disadvantage of HIP processing is that, due to the high temperatures and high pressures used during the HIP processing, the previously known HIP equipment is extremely massive in construction and expensive to produce and acquire. Furthermore, the long cycle time for the HIP processing limits the production volume of HIP equipment and greatly increases the per part cost of the parts which are HIP treated.

SUMMARY OF THE PRESENT INVENTION

The present invention provides a method for densifying previously sintered parts which overcomes all of the above mentioned disadvantages of HIP processing.

In brief, the method of the present invention comprises placing previously sintered parts within a pressurizable chamber. The parts may be either vacuum or hydrogen sintered and, similarly, may be cooled following the sintering step.

The parts are then heated to their liquid phase temperature. The liquid phase temperature will vary, of course, depending upon the part material. Typically, however, the liquid phase temperature is in the range of 1,300° C. to 1,600° C.

With the parts at their liquid phase temperature, the pressure vessel is pressurized with an inert gas, such as argon, to a range of 50–2,000 psi. The parts are maintained within the pressure vessel at their liquid phase temperature and subject to a pressure of 50–2,000 psi for a relatively short period of time, typically 30–60 minutes, and then removed from the furnace chamber. The pressure vessel can be heated first and then pressurized, pressurized first and the heated or simultaneously pressurized and heated.

In practice, the method of the present invention substantially eliminates all porosity within the parts as well as closing larger randomly spaced holes, slits or fractures in the part in a manner comparable to and, in many cases, superior to HIP processing. Previously it has not been known that porosity and flow closures could be effected at pressures in the range of 50 psi–2000 psi.

BRIEF DESCRIPTION OF THE DRAWING

A better understanding of the present invention will be had with reference to the following detailed description when read in conjunction with the accompanying drawing, in which.

DETAILED DESCRIPTION OF A PREFERRED EMBODIMENT OF THE PRESENT INVENTION

The method of the present invention is designed to further densify previously sintered parts constructed from powdered metal, ceramics, or the like. As used in this application, previously sintered parts mean parts that have been raised to liquid phase temperature regardless of whether the parts are cooled following sinter. It has been found through test results that the method used to sinter the parts, i.e., whether the parts were subjected to vacuum pumping or a wash gas during the sintering operation, has no observable effect on the parts following the treatment of the parts by the present method. Similarly, whether or not the sintered parts have been cooled following the sintering operation has no observable effect on the parts following treatment of the parts by the present method.

In brief, in the method of the present invention the sintered parts are placed within a pressurizable chamber. The parts are then heated to the liquid phase temperature, i.e., the melting, point of the parts. The chamber is also pressurized with an inert gas, such as argon, to a pressure of 50–2,000 psi. The parts are maintained at their liquid phase temperature and at a pressurization of 50–2,000 psi for a relatively short period of time, typically 30–60 minutes.

Following the predetermined period of time, the chamber is depressurized and the parts are removed. Test results have established that the method of the present invention effectively eliminates substantially all porosity within the sintered part as well as closing large holes or flaws that are present in the part following the sintering operation in a manner comparable and in many cases, superior to HIP processing.

The following examples indicates how the method of the present invention may be used to close a large flaw as well as decrease the porosity in a sintered part:

EXAMPLE 1

Conventional vacuum sintering to show a large flaw.

Figure 1:
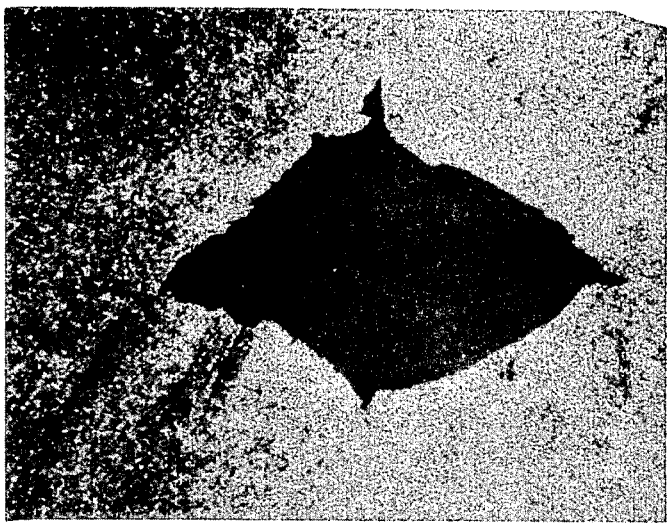
FIGS. 1–14 are all microphotographs of the cross section of parts illustrating the present invention.

1. Material—(90%WC-10%Co) Medium size grain alloy; Ra 88.6.
2. Place 15 grams of powder in one inch diameter mold.
3. Place paraffin shaving—½" long, approximately 0.02" diameter—on powder to produce medium size flaw.
4. Add 15 grams of powder.
5. Place paraffin shaving—½" long, approximately 0.05" diameter—on powder to produce large flaw.
6. Add another 15 grams of powder.
7. Press powder mechanically at 30,000 psi.
8. Vacuum dewax bar at 500° C.
9. Sintering Cycle—Temperature 1415° C.
Pressure—100 microns Hg.
Time—90 minutes, then cool The resulting cemented tungsten carbide bar from Example 1 has two large flaws, one of which is shown in FIG. 1 at 75X magnification.

EXAMPLE 2

The parts produced by the steps described in Example 1 were then subjected to the following steps:
1. Maintained at liquid phase temperature following sinter—1415° C.
2. Pressurized with argon gas to pressure of 250 psi.
3. Time—30 minutes.

Figure 2:
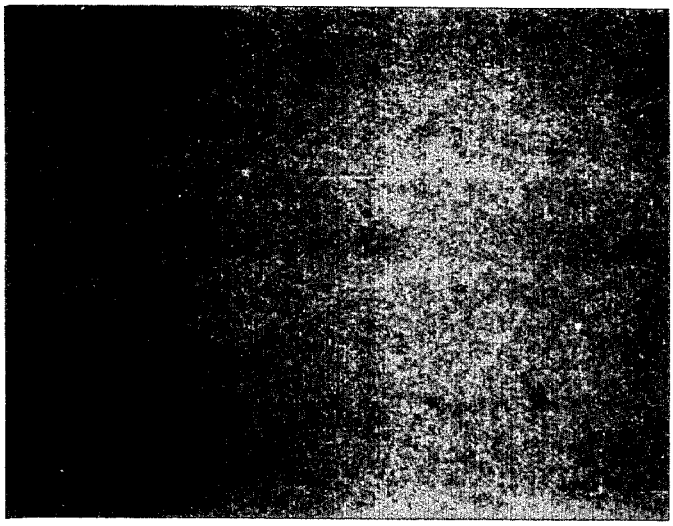
Figure 3:
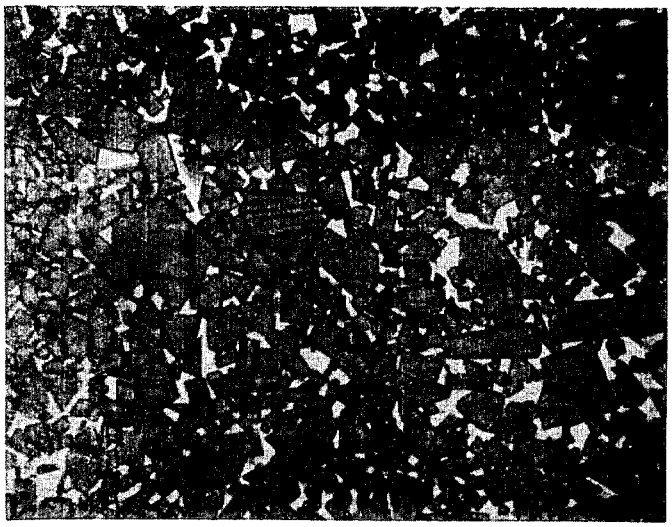

FIGS. 2 and 3 illustrate the complete closure of the large flaw at 75X and 1500X magnification, respectively.

EXAMPLE 3

The parts produced by the steps described in Example 1 were then subjected to the following steps:
1. Parts maintained at 1415° C. following sinter.
2. Pressurized with argon to 90 psi.
3. Time—30 minutes.

Figure 4:
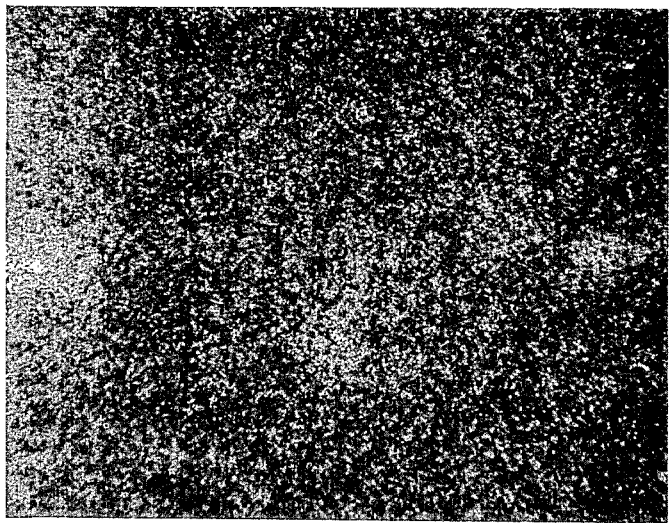
Figure 5:
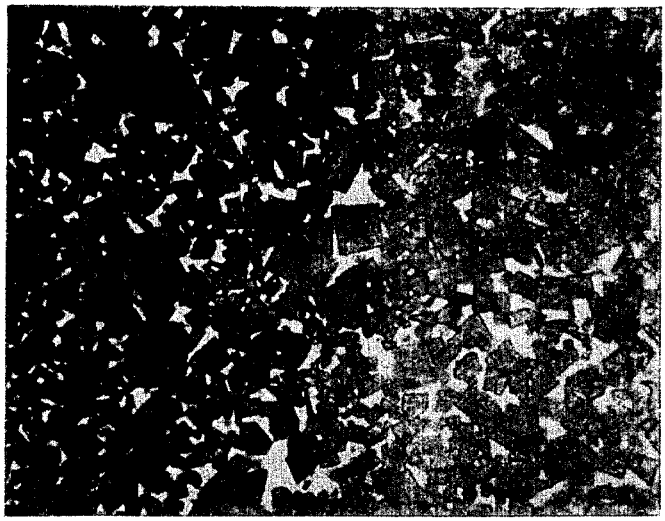

FIGS. 4 and 5 illustrate complete closure of the large flaw at 75X and 1500X magnification, respectively.

EXAMPLE 4

1. Repeat steps 1-7 of Example 1.
2. Vacuum dewax at 500° C.
3. Hydrogen sinter in stoking furnace.
Temperature—1415° C.
Time—90 minutes.

Figure 6:
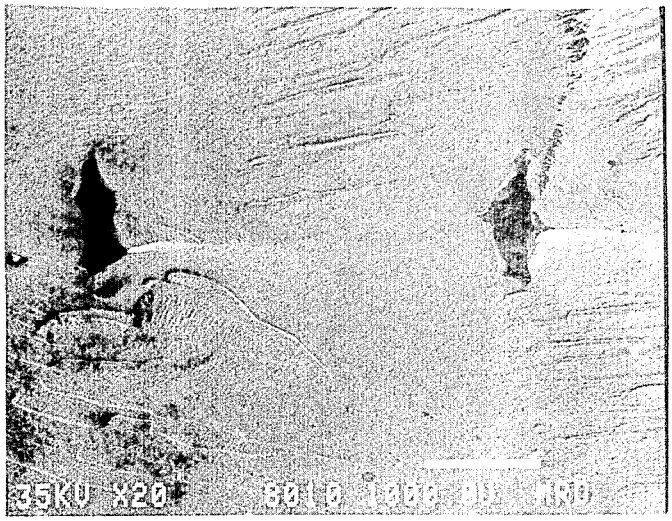

The resulting cemented tungsten carbide bar from Example 4 has two large flaws as shown in FIG. 6 at 20X magnification.

EXAMPLE 5

The parts from the lot of Example 4 were then subjected to the following steps:
1. Pressurized with argon to 160 psi at room temperature.
2. Heated to liquid phase temperature—1415° C. whereupon the pressure rises to 250 psi.
3. Maintained at temperature and pressure for 30 minutes.

Figure 7:
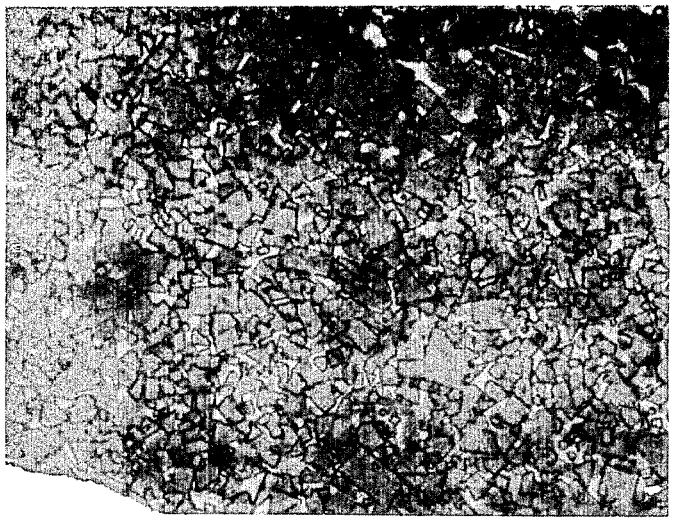
Figure 8:
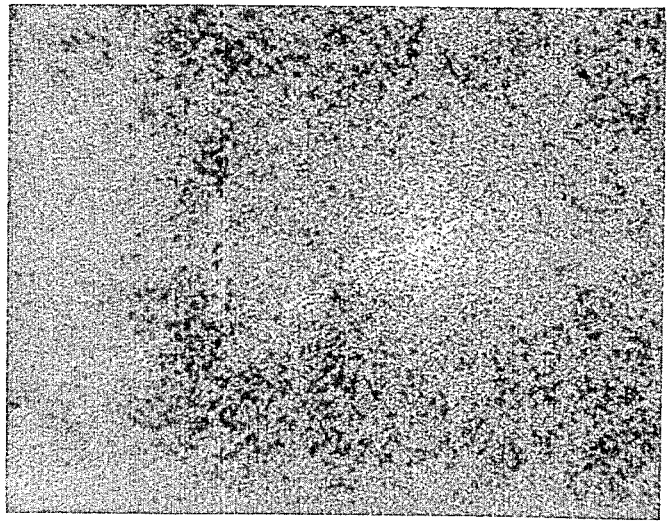

FIGS. 7 and 8 show complete closure of the large flaw at 1500X and 75X magnification, respectively.

EXAMPLE 6

Figure 9:
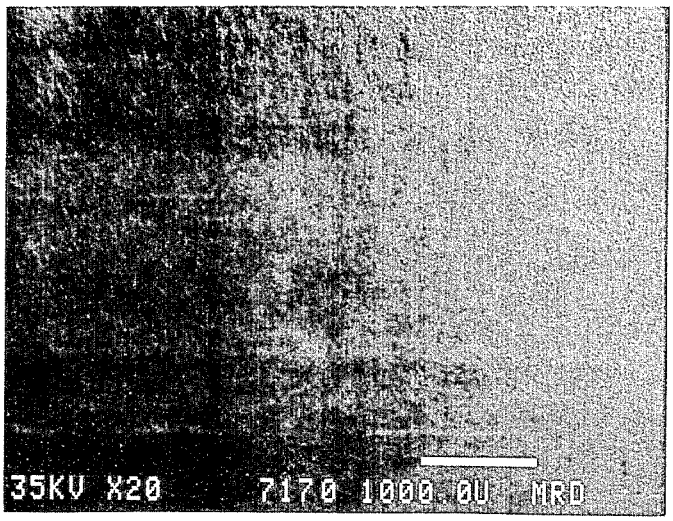
Figure 10:
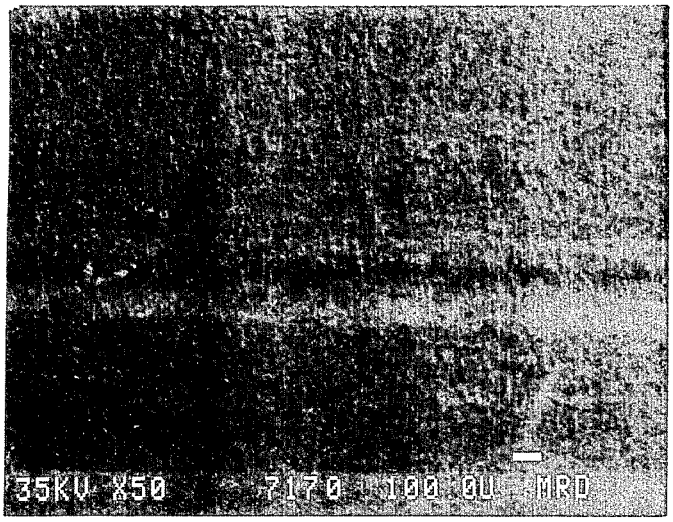

The parts from the lot of Example 1 were treated the same as Example 5 except that the parts were dewaxed in hydrogen atmosphere rather than vacuum dewaxed. FIGS. 9 and 10 illustrate complete closure of the large flaw at 20X and 50X magnification, respectively.

EXAMPLE 7

The parts from the lot of Example 1 were treated in the same fashion as Example 2 except that the parts were cooled following sinter.

Figure 11:
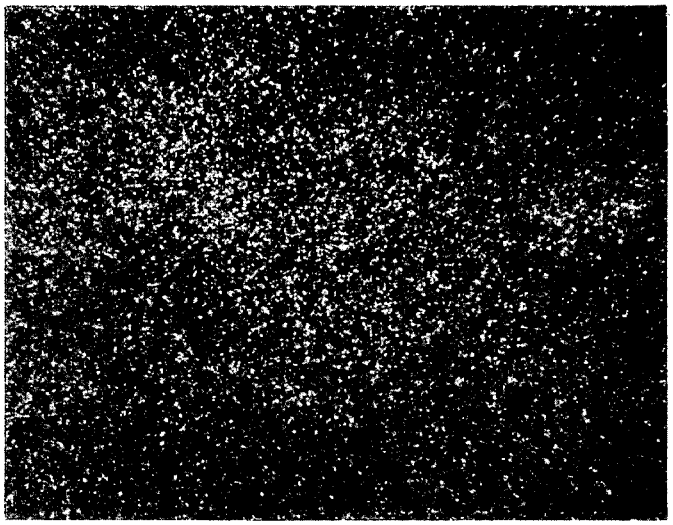
Figure 12:
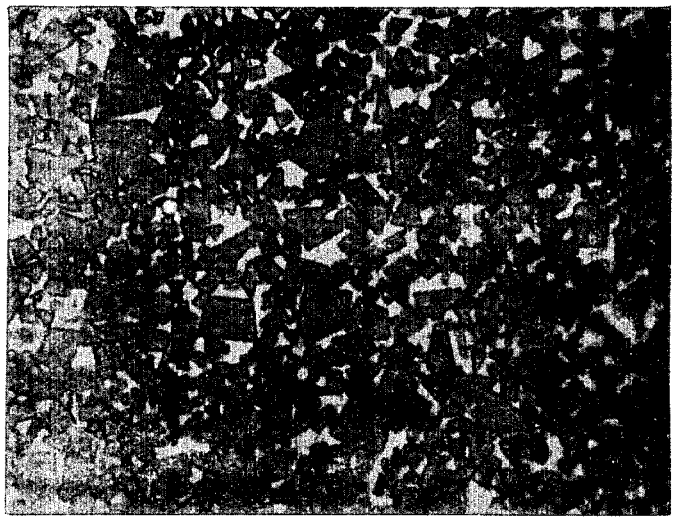

FIGS. 11 and 12 show complete closure of the large flaw at 75X and 1500X magnification, respectively.

EXAMPLE 8

The parts were processed in a manner identical to Example 1 except that 16% cobalt powder was used.

The the following steps were performed:
1. Heat parts to liquid phase temperature—1415° C.
2. Pressure to 50 psi and hold for 30 minutes.

Figure 13:
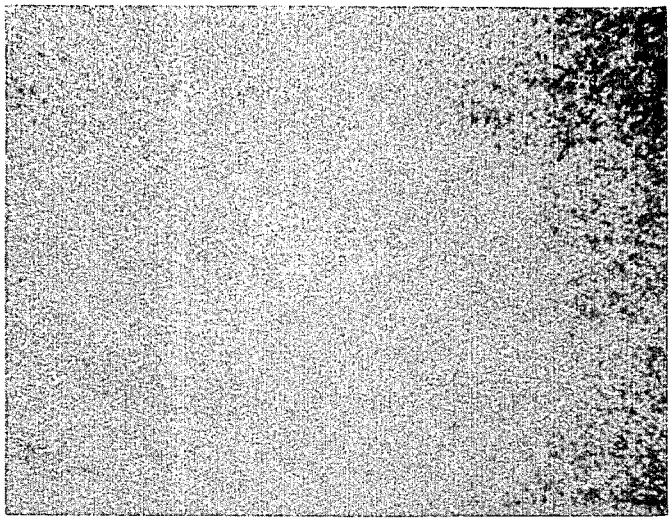
Figure 14:
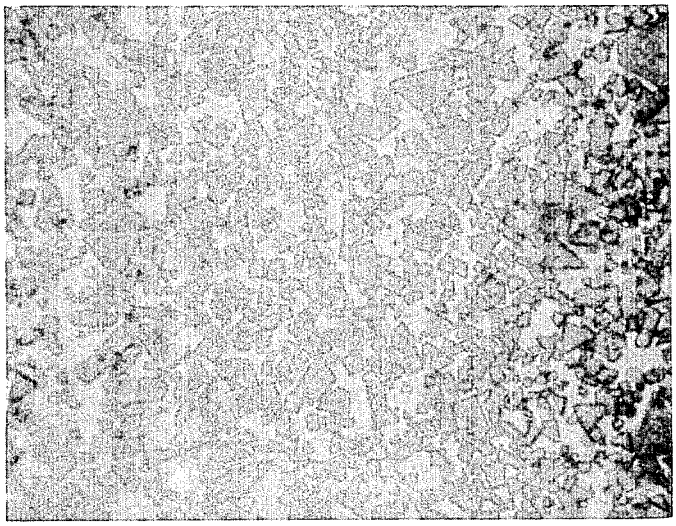

FIGS. 13 and 14 illustrate complete closure of the flaws at 75X and 1500X magnification, respectively. Test results have also shown that with 10% cobalt material, complete closure of the flaws is not possible at 50 psi.

From the foregoing, it can be seen that the method of the present invention provides a substantial increase in the densification of a previously sintered part. As previously set forth, the actual method employed in sintering the part has no observable effect on the densification or hole closure obtained by the practice of the present method. Likewise, it does not matter whether or not the sintered parts are cooled prior to treating the parts according to the method of the present invention nor does it matter if the parts are exposed to air following sinter.

The densification and microstructural development of sintered parts obtained by the method of the present invention are comparable or even superior to the corresponding densification and microstructure development obtainable from the previously known HIP process. The present invention, however, is advantageous over the HIP process since the present method employs comparatively much lower pressures than those used in the HIP process. As such, the machinery and equipment necessary to practice the method of the present invention is much less massive and, therefore, much less expensive in construction than the corresponding machinery equipment necessary for the HIP process.

A still further advantage of the method of the present invenion is that the cycle time of the present method is much shorter than the corresponding cycle time of the HIP process. As such, a much greater volume of parts can be processed from a similarly sized furnace while practicing the present method than can be processed over the same time period with a similarly sized furnace using the HIP process.

Although the method of the present invention pressurizes the parts to a pressurization of between 50-2,000 psi, preferably this pressure range is 50-1,000 psi and, still preferably, 50-300 psi. Likewise, although many types of metallurgical furnaces can be used to practice the method of the present invention, preferably, the metallurgical furnace described in my copending patent application entitled "Metallurgical Furnace" and filed on Mar. 22, 1982 and assigned Ser. No. 360,337 is used to practice the method of the present invention.

Having described my invention, however, many modifications thereto will become apparent to those skilled in the art to which it pertains without deviation from the spirit of the invention as defined by the scope of the appended claims.

I claim:

1. A method for densifying previously sintered parts constructed from powdered metals, ceramics or the like comprising the steps of:

heating said parts above the liquid phase temperature of the parts, applying a pressure in the range of 50–1,000 psi to said parts for a predetermined period of time while maintaining said parts above said liquid phase temperature.

2. The method as defined in claim 1 wherein said pressure applying step comprises applying a pressure to said parts in the range of 50–300 psi.

3. The method as defined in claim 1 wherein said pressure applying step comprises the steps of:

placing said parts in a pressurizable chamber, and p1 introducing a sufficient amount of an inert gas to said chamber to create a pressure in said pressure range.

4. The method as defined in claim 3 wherein said inert gas comprises argon.

5. The method as defined in claim 1 wherein said predetermined period of time is in the range of 30–60 minutes.

6. A method for densifying previously sintered parts constructed from powdered tungsten and cobalt comprising the steps of:

heating said parts above the liquid phase temperature of the parts, applying a pressure in the range of 50–1,000 psi to said parts for a predetermined period of time while maintaining said parts above said liquid phase temperature.

* * * * *

UNITED STATES PATENT AND TRADEMARK OFFICE

CERTIFICATE OF CORRECTION

PATENT NO. : 4,431,605

DATED : February 14, 1984

INVENTOR(S) : Roy C. Lueth

It is certified that error appears in the above—identified patent and that said Letters Patent is hereby corrected as shown below:

Column 4, line 11 delete "wa" insert --was--.

Column 4, line 12 delete "the" second occurrence.

Column 4, line 32 delete "obtained" insert --obtainable--.

Column 4, line 45 delete "invenion" insert --invention--.

Column 5, line 16 delete "pl".

Signed and Sealed this

*Eleventh* Day of *September 1984*

[SEAL]

*Attest:*

GERALD J. MOSSINGHOFF

*Attesting Officer*

*Commissioner of Patents and Trademarks*